US011043732B2

(12) United States Patent
Chang et al.

(10) Patent No.: US 11,043,732 B2
(45) Date of Patent: Jun. 22, 2021

(54) ANTENNA STRUCTURE

(71) Applicant: Chiun Mai Communication Systems, Inc., New Taipei (TW)

(72) Inventors: Yun-Jian Chang, New Taipei (TW); Jung-Chin Lin, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 55 days.

(21) Appl. No.: 16/542,430

(22) Filed: Aug. 16, 2019

(65) Prior Publication Data

US 2020/0058981 A1 Feb. 20, 2020

(30) Foreign Application Priority Data

Aug. 17, 2018 (CN) ..... 201810942117.X

(51) Int. Cl.

| | |
|---|---|
| ***H01Q 1/24*** | (2006.01) |
| ***H01Q 1/48*** | (2006.01) |
| ***H01Q 5/30*** | (2015.01) |
| ***H01Q 1/22*** | (2006.01) |
| ***H01Q 1/50*** | (2006.01) |
| ***H01Q 1/52*** | (2006.01) |

(52) U.S. Cl.
CPC ..... *H01Q 1/24* (2013.01); *H01Q 1/48* (2013.01); *H01Q 5/30* (2015.01)

(58) Field of Classification Search
CPC .. H01Q 1/22; H01Q 1/50; H01Q 1/52; H01Q 5/28; H01Q 5/328; H01Q 5/30; H01Q 1/24; H01Q 1/48
USPC ..... 343/702, 700 MS, 872, 767, 769, 795
See application file for complete search history.

(56) References Cited

U.S. PATENT DOCUMENTS

| | | | | |
|---|---|---|---|---|
| 2017/0033812 | A1* | 2/2017 | Son | H04B 1/0483 |
| 2019/0020114 | A1* | 1/2019 | Paulotto | H01Q 5/378 |
| 2020/0076059 | A1* | 3/2020 | Hsiao | H01Q 9/42 |
| 2020/0321688 | A1* | 10/2020 | Khripkov | H01Q 1/243 |

FOREIGN PATENT DOCUMENTS

| | | |
|---|---|---|
| CN | 107039766 A | 8/2017 |

* cited by examiner

*Primary Examiner* — Wei (Victory) Y Chan
(74) *Attorney, Agent, or Firm* — ScienBiziP, P.C.

(57) ABSTRACT

An antenna structure includes a border frame, a first feed portion, and a second feed portion. The border frame includes an end portion, a first side portion, and a second side portion. The border frame defines a first gap, a second gap, a first slot, and a second slot. The first gap and the second gap are disposed in the end portion. The first slot is disposed in the first side portion. The second slot is disposed in the second side portion. The first gap, the second gap, the first slot, and the second slot divide the border frame into two radiating portions. The first feed portion and the second feed portion are electrically coupled to the two radiating portions and supply current to the two radiating portions respectively.

14 Claims, 14 Drawing Sheets

ANTENNA STRUCTURE

FIELD

The subject matter herein generally relates to antenna structures, and more particularly to an antenna structure of a wireless communication device.

BACKGROUND

As electronic devices become smaller, an antenna structure for operating in different communication bands is required to be smaller.

BRIEF DESCRIPTION OF THE DRAWINGS

Implementations of the present disclosure will now be described, by way of embodiments only, with reference to the attached figures.

DETAILED DESCRIPTION

Figure 1:
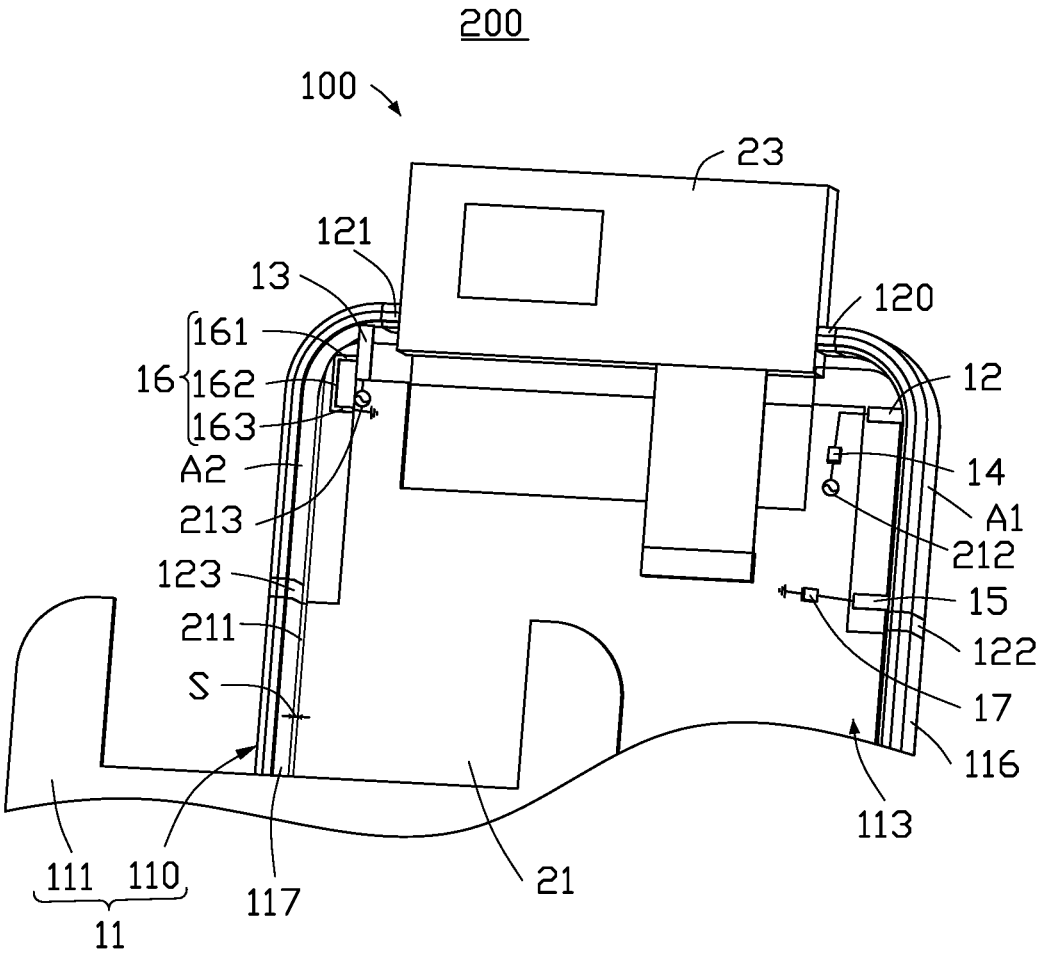
FIG. 1 is a partial isometric view of an embodiment of an antenna structure in a wireless communication device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

Figure 2:
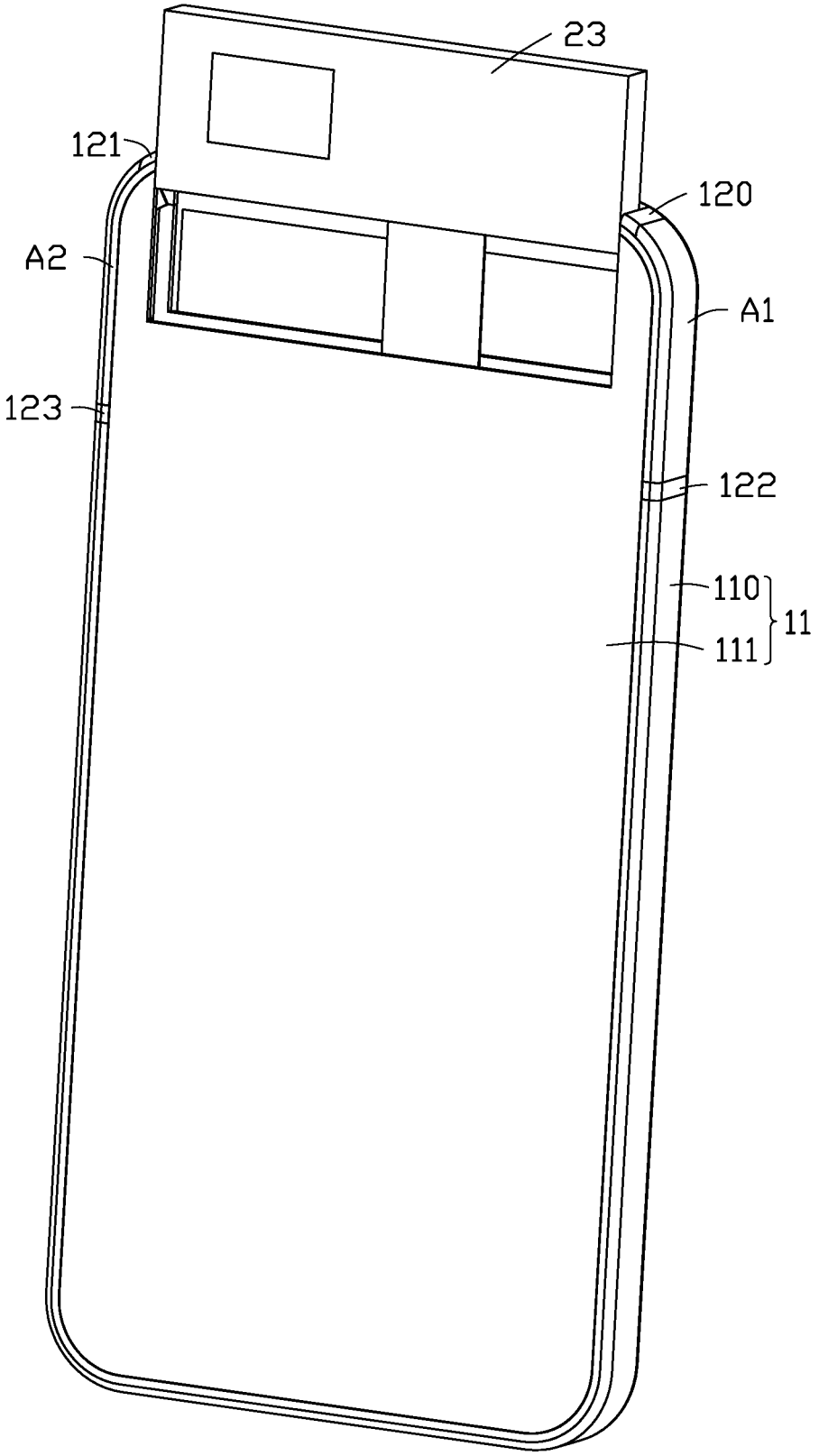
FIG. 2 is an isometric view of the communication device in FIG. 1.
Figure 3:
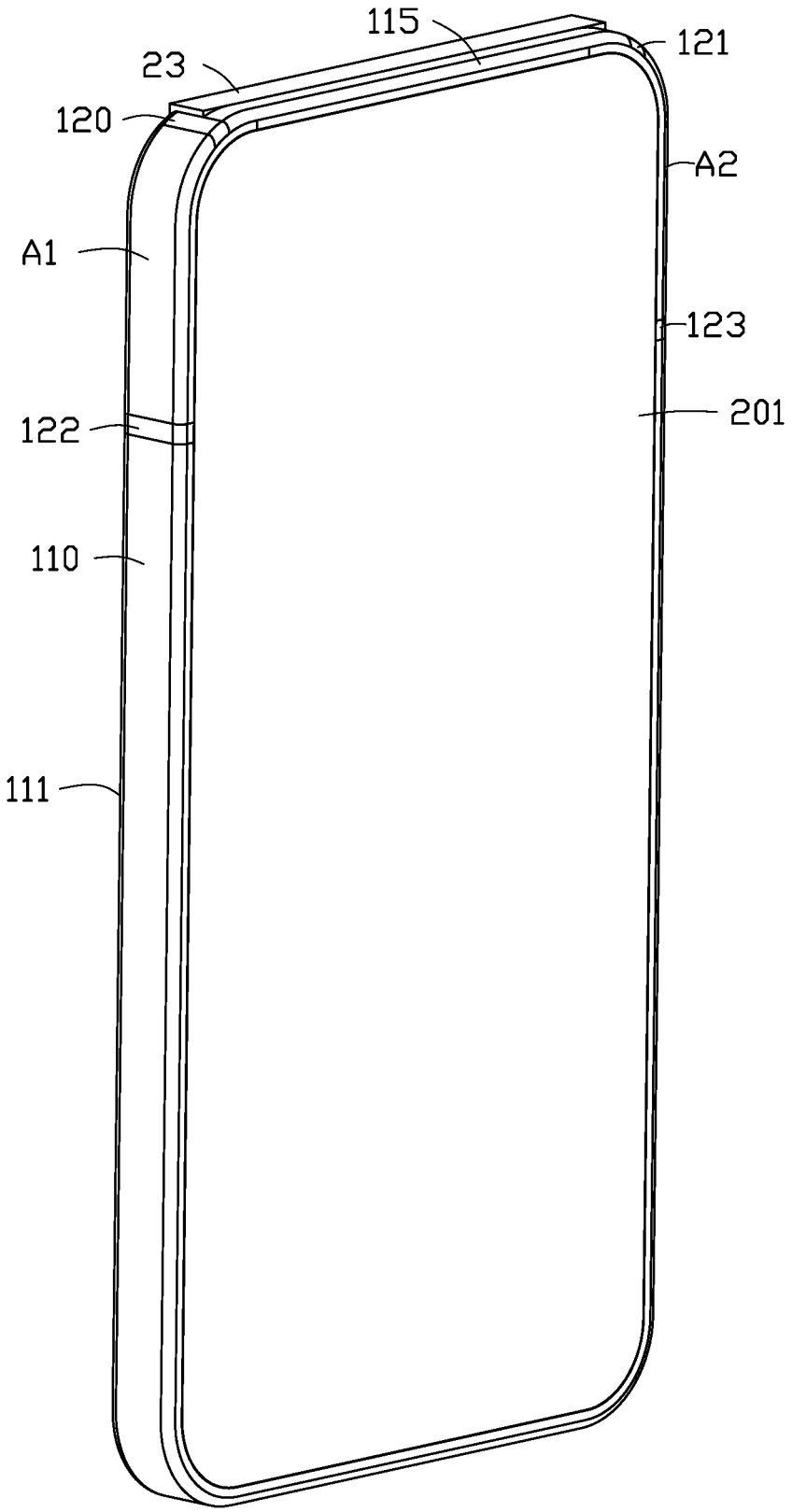
FIG. 3 is similar to FIG. 2, but showing the communication device from another perspective.

FIGS. 1-3 show an embodiment of an antenna structure 100 applicable in a mobile phone, a personal digital assistant, or other wireless communication device 200 for sending and receiving wireless signals.

As shown in FIG. 1, the antenna structure 100 includes a housing 11, a first feed portion 12, a second feed portion 13, a matching circuit 14, a connecting portion 15, and an extending portion 16.

The housing 11 includes at least a border frame 110 and a backplane 111. The border frame 110 and the backplane 111 are made of metal. The border frame 110 is hollow rectangular and is made of metal. The border frame 110 receives a display unit 201 in one side of the border frame 110 (shown in FIG. 3).

The backplane 111 is made of metal and is mounted on a side of the border frame 110 opposite to the display unit 201. The backplane 111 and the display unit 201 are parallel and spaced apart. In one embodiment, the backplane 111 and the border frame 110 cooperatively define an accommodating space 114. The accommodating space 114 receives components (not shown) of the wireless communication device 200.

The border frame 110 includes at least an end portion 115 (shown in FIG. 3), a first side portion 116, and a second side portion 117. In one embodiment, the end portion 115 is a top end of the wireless communication device 200. The first side portion 116 and the second side portion 117 face each other and are perpendicular to the end portion 115. The end portion 115, the first side portion 116, and the second side portion 117 are each connected to the backplane 111 and the display unit 201. In addition, in one embodiment, a length of each of the first side portion 116 and the second side portion 117 is longer than a length of the end portion 115.

The border frame 110 includes a first gap 120, a second gap 121, a first slot 122, and a second slot 123. The first gap 120 and the second gap 121 are disposed in the end portion 115. The first gap 120 is located adjacent to the first side portion 116, and the second gap 121 is located adjacent to the second side portion 117. The first slot 122 is disposed in the first side portion 116 and spaced from the first gap 120. The second slot 123 is disposed in the second side portion 117 and spaced from the second gap 121.

The first gap 120, the second gap 121, the first slot 122, and the second slot 123 pass through the border frame and divide the border frame 110 into a first radiating portion A1 and a second radiating portion A2. The first radiating portion A1 is disposed in a portion of the border frame 110 between the first gap 120 and the first slot 122. The second radiation portion A2 is disposed in a portion of the border frame 110 between the second gap 121 and the second slot 123. Thus, the first radiating portion A1 and the second radiating portion A2 are located respectively on different sides of the end portion 115, such as two corner portion of the border frame 110.

In other embodiments, the first gap 120 and the second gap 121 can be disposed in different locations of the border frame 110. In one embodiment, the first gap 120 may be disposed in the first side portion 116, and the second gap 121 may be disposed in the second side portion 117, such that the first radiating portion A1 and the second radiating portion A2 are located respectively on opposite sides of the end portion 115.

In one embodiment, the first gap 120, the second gap 121, the first slot 122, and the second slot 123 are filled with insulating material, such as plastic, rubber, glass, wood, or ceramic.

In one embodiment, the wireless communication device 200 is about 70 mm*140 mm*8 mm in size. The wireless communication device 200 further includes a substrate 21 and an electronic component 23. The substrate 21 is a printed circuit board made of epoxy glass fiber (FR4) or other dielectric material. The substrate 21 is received within the accommodating space 113. At least one end of the substrate 21 is spaced from the border frame 110 and forms a clearance area 211.

In one embodiment, the electronic component 23 is an optical module. The electronic component 23 is connected and electrically coupled to the substrate 21. In one embodiment, the optical module may include at least one of a camera module, an auxiliary display screen, an ambient light sensor, and a proximity detector. In other embodiments, the electronic component 23 may be an acoustic module including at least one of a speaker, a microphone, and a vibration motor.

In one embodiment, the wireless communication device 200 includes a sliding structure (not shown) connected to the electronic component 23 and adapted to control the electronic component 23 to slide relative to the border frame 110. When the electronic component 23 is in a first position, such as when the electronic component 23 is mounted within the border frame 110, the electronic component 23 is in a closed state. When the electronic component 23 is slide to a second position, such as when the electronic component 23 is slid out of the border frame 110 such as from the end portion 115, the electronic component 23 is in an activated state. In one embodiment, the first radiating portion A1 and the second radiating portion A2 are located respectively on opposite sides of the electronic component 23. Thus, the electronic component 23 does not interfere with a resonance capacity of the first radiating portion A1 and the second radiating portion A2.

Figure 4:
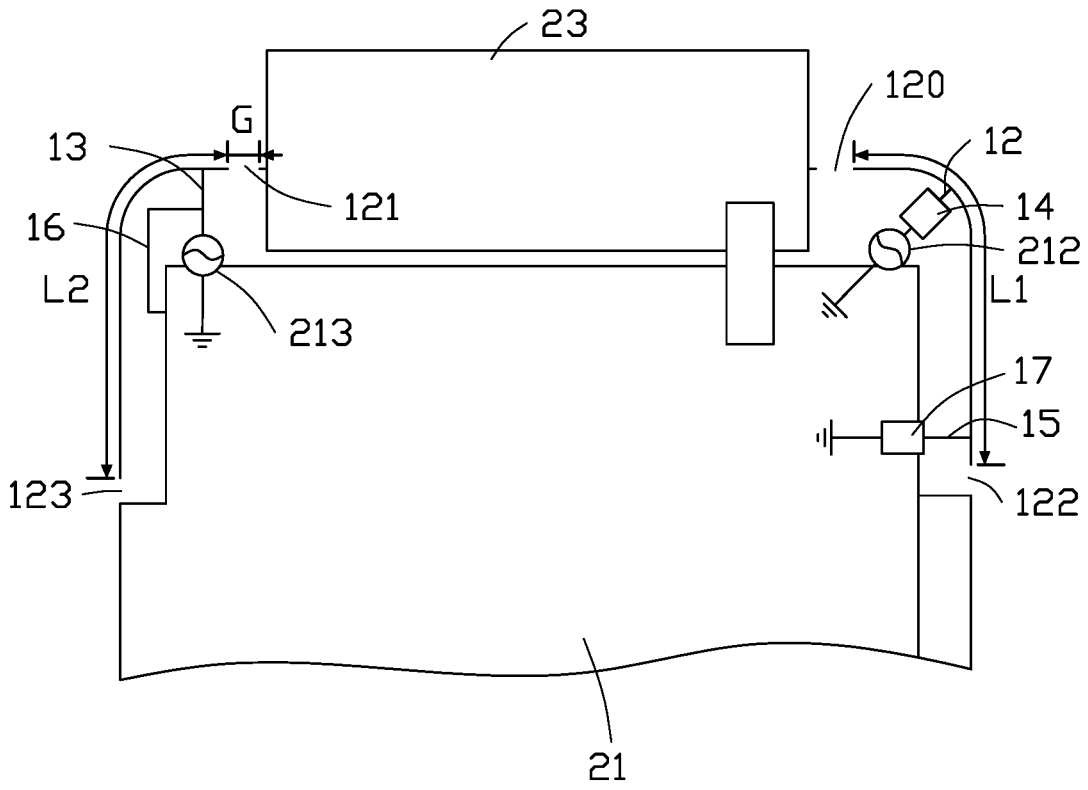
FIG. 4 is a diagram of the antenna structure in FIG. 1.

As shown in FIG. 4, in one embodiment, each of the first gap 120, the second gap 121, the first slot 122, and the second slot 123 has a width G The first radiating portion A1 between the first gap 120 and the first slot 122 has a length L1. The second radiating portion A2 between the second gap 121 and the second slot 123 has a length L2. The clearance area 211 has a width S (FIG. 1). In one embodiment, G is equal to 2 mm, L1 is equal to 34 mm, L2 is equal to 34 mm, and S is equal to 2.5 mm.

In one embodiment, the first feed portion 12 is mounted within the accommodating space 113. The first feed portion 12 may be a resilient metal piece, a screw, a feed line, a needle, or other connecting structure. One end of the first feed portion 12 is electrically coupled to a side of the first radiating portion A1 adjacent to the first gap 120, and a second end of the first feed portion 12 is electrically coupled through the matching circuit 14 to an end of the first feed source 212 mounted to the substrate 21 for feeding a current to the first radiating portion A1. A second end of the first feed source 212 is grounded.

The second feed portion 13 is mounted within the accommodating space 113. The second feed portion 13 may be a resilient metal piece, a screw, a feed line, a needle, or other connecting structure. One end of the second feed portion 13 is electrically coupled to the second radiating portion A2, and a second end of the second feed portion 13 is electrically coupled to an end of the second feed source 213 mounted to the substrate 21 for feeding a current to the second radiating portion A2. A second end of the second feed source 213 is grounded.

The connecting portion 15 is mounted within the accommodating space 113. The connecting portion 15 may be a resilient metal piece, a screw, a feed line, a needle, or other connecting structure. One end of the second feed portion 13 is electrically coupled to the second radiating portion A2, and a second end of the second feed portion 13 is electrically coupled to one end of the second feed source 213 mounted to the substrate 21 for feeding a current to the second radiating portion A2. A second end of the second feed source 213 is grounded.

The extending portion 16 is mounted within the accommodating space 113 between the second feed portion 13 and the second side portion 117. The extending portion 16 includes a first extending section 161, a second extending section 162, and a third extending section 163 connected in sequence. One end of the first extending section 161 is perpendicularly connected to a side of the second feed portion 13 away from the first side portion 116 and extends parallel to the end portion 115 in a direction toward the second side portion 117. One end of the second extending section 162 is perpendicularly connected to an end of the first extending section 161 away from the second feed portion 13 and extends parallel to the first side portion 116 and extends in a direction opposite to the end portion 115. One end of the third extending section 163 is connected perpendicularly to an end of the second connecting section 162 away from the first extending section 161 and extends parallel to the first extending section 161 and extends in a direction toward the first side portion 116. A second end of the third extending section 163 is grounded.

The first extending section 161 and the third extending section 163 are connected respectively to opposite ends of the second extending section 162 and cooperatively make a U-shaped structure. A shape of the extending portion 16 may be other shapes in other embodiments according to requirements.

Figure 5:
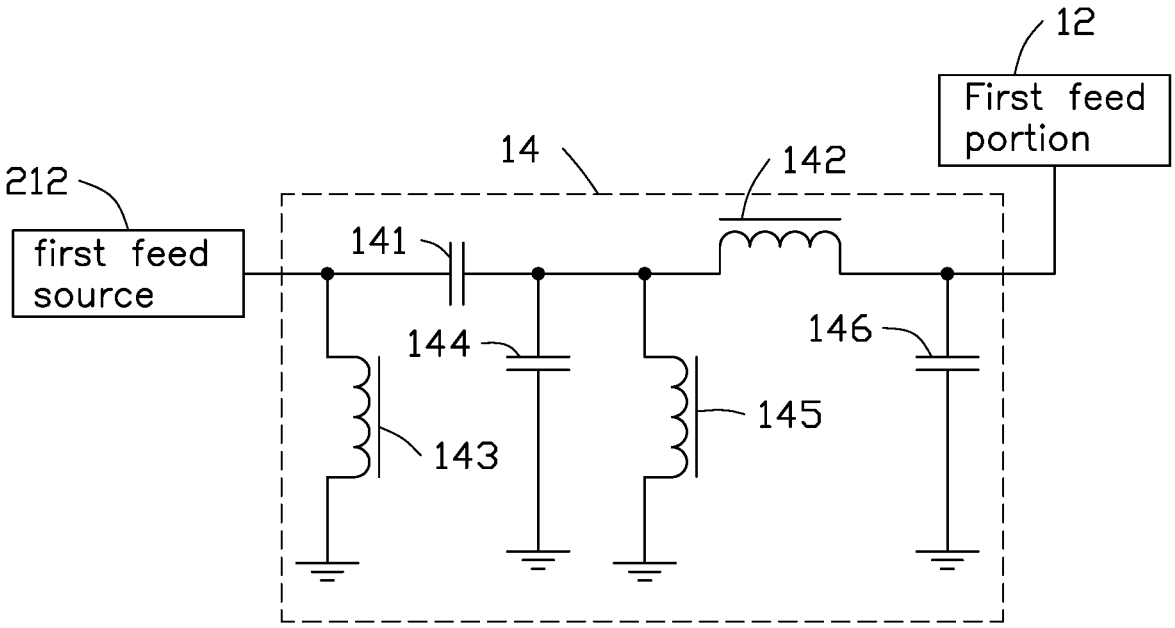
FIG. 5 is a diagram of a matching circuit of the antenna structure in FIG. 4.

As shown in FIG. 5, in one embodiment, the matching circuit 14 includes a first matching component 141, a second matching component 142, a third matching component 143, a fourth matching component 144, a fifth matching component 145, and a sixth matching component 146. One end of the first matching component 141 is electrically coupled to the first feed source 212. A second end of the first matching component 141 is coupled in series to the second matching component 142 and electrically coupled to the first feed portion 12, and then electrically coupled to the first radiating portion A1 through the first feed portion 12.

One end of the third matching component 143 is electrically coupled between the first matching component 141 and the first feed source 212, and a second end of the third matching component 143 is grounded. One end of the fourth matching component 144 is electrically coupled between the first matching component 141 and the second matching component 142, and a second end of the fourth matching component 144 is grounded. The fifth matching component 145 and the fourth matching component 144 are coupled in parallel. One end of the fifth matching component 145 is electrically coupled between the first matching component 141 and the second matching component 142, and a second end of the fifth matching component 145 is grounded. One end of the sixth matching component 146 is electrically coupled between the second matching component 142 and the first feed portion 12, and a second end of the sixth matching component 146 is grounded.

In one embodiment, the first matching component 141, the fourth matching component 144, and the sixth matching component 146 are capacitors, and the second matching component 142, the third matching component 143, and the fifth matching component 145 are inductors. The first matching component 141, the fourth matching component 144, and the sixth matching component 146 have a capacitance of 1 pF, 0.5 pF, and 3 pF, respectively. The second matching component 142, the third matching component 143, and the fifth matching component 145 have an inductance of 1.8 nH, 12 nH, and 6.2 nH. In other embodiments, the first matching component, 141, the second matching component 142, the third matching component 143, the fourth matching component 144, the fifth matching component 145, and the sixth matching component 146 may have other values of capacitance, inductance, or a combination of the two.

When the first feed source 212 supplies a current, the current from the first feed source 212 flows through the matching circuit 14 and the first feed portion 12 to the first radiating portion A1. Thus, the first radiating portion A1 forms a first antenna to excite a first resonance mode and generate a radiation signal in a first frequency band. When the second feed source 213 supplies a current, the current from the second feed source 213 flows through the second feed portion 13 to the second radiating portion A2. Thus, the second radiating portion A2 forms a second antenna to excite a second resonance mode and generate a radiation signal in a second frequency band.

In one embodiment, the first antenna is a diversity antenna, and the second antenna is a global positioning system (GPS) antenna. The first resonance mode is a Long Term Evolution Advanced (LTE-A) low-frequency mode, and the second resonance mode is a GPS mode. The first frequency band is 700-960 MHz. The second frequency band is about 1575 MHz.

In one embodiment, the antenna structure 100 further includes a switching circuit 17. The switching circuit 17 is mounted within the accommodating space 113. One end of the switching circuit 17 is electrically coupled to the connecting portion 15 to electrically couple to the first radiating portion A1. A second end of the switching circuit 17 is grounded.

Figure 6:
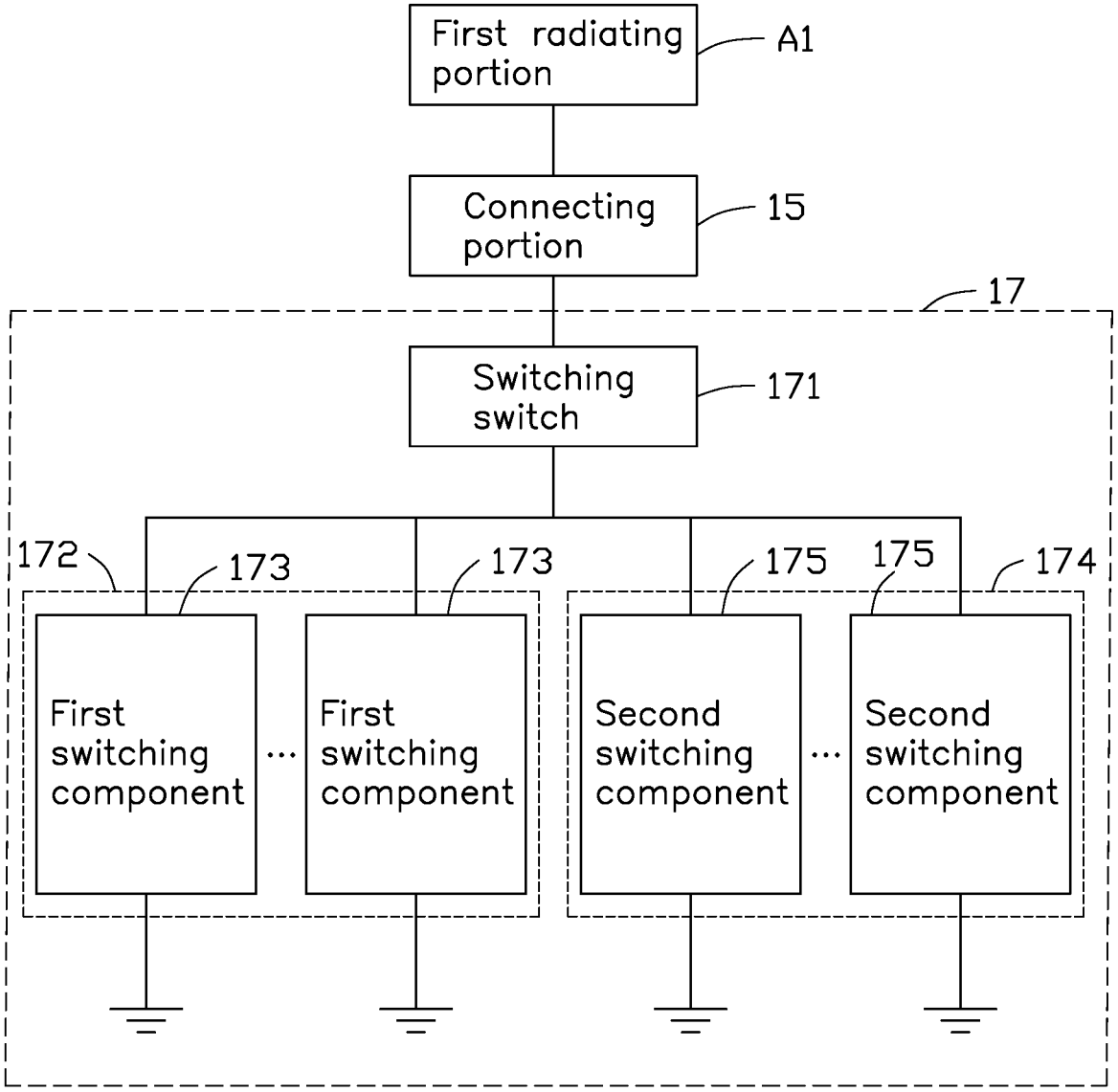
FIG. 6 is a block diagram of a switching circuit of the antenna structure in FIG. 4.

As shown in FIG. 6, the switching circuit 17 includes a switch 171, a first switching unit 172, and a second switching unit 174. The switch 171 is electrically coupled to the connecting portion 15 to electrically couple to the first radiating portion A1. The first switching unit 172 includes a plurality of first switching components 173. Each one of the plurality of first switching components 173 may be an inductor, a capacitor, or a combination of the two. The first switching components 173 are coupled together in parallel. One end of each of the first switching components 173 is electrically coupled to the switch 171, and a second end of each of the first switching components 173 is grounded. The second switching unit 174 includes a plurality of second switching components 175. Each of the plurality of second switching components 175 may be an inductor, a capacitor, or a combination of the two. The second switching components 175 are coupled together in parallel. One end of each of the second switching components 175 is electrically coupled to the switch 171, and a second end of each of the second switching components 175 is grounded.

By controlling the switch 171, the first radiating portion A1 is switched to electrically couple to the first switching components 173 or the second switching components 175. Since each of the first switching components 173 and each of the second switching components 175 include different impedances, the LTE-A low-frequency mode can be adjusted.

In one embodiment, the first switching unit 172 includes four switching components 173 each having a different impedance. When the electronic component 23 is in the closed state, the first radiating portion A1 is switched to four different first switching components 173 having impedance values of 16 nH, 10 nH, 5.1 nH, and 3.3 nH to cause the antenna structure 100 to operate in a 700 MHz frequency band, an 800 MHz frequency band, an 850 MHz frequency band, and a 900 MHz frequency band, respectively. Thus, the LTE-A low-frequency mode covers the frequency band from 700-960 MHz. When the electronic component 23 is in the activated state, the radiating portion A1 is switched to four different second switching components 175 having impedance values of 15 nH, 9.1 nH, 3.9 nH, and 1.8 nH to cause the antenna structure 100 to operate in a 700 MHz frequency band, an 800 MHz frequency band, an 850 MHz frequency band, and a 900 MHz frequency band, respectively. Thus, the LTE-A low-frequency mode covers the frequency band from 700-960 MHz. Thus, the impedance value of each of the first switching components 173 is greater than the impedance value of the corresponding second switching component 175.

Figure 7:
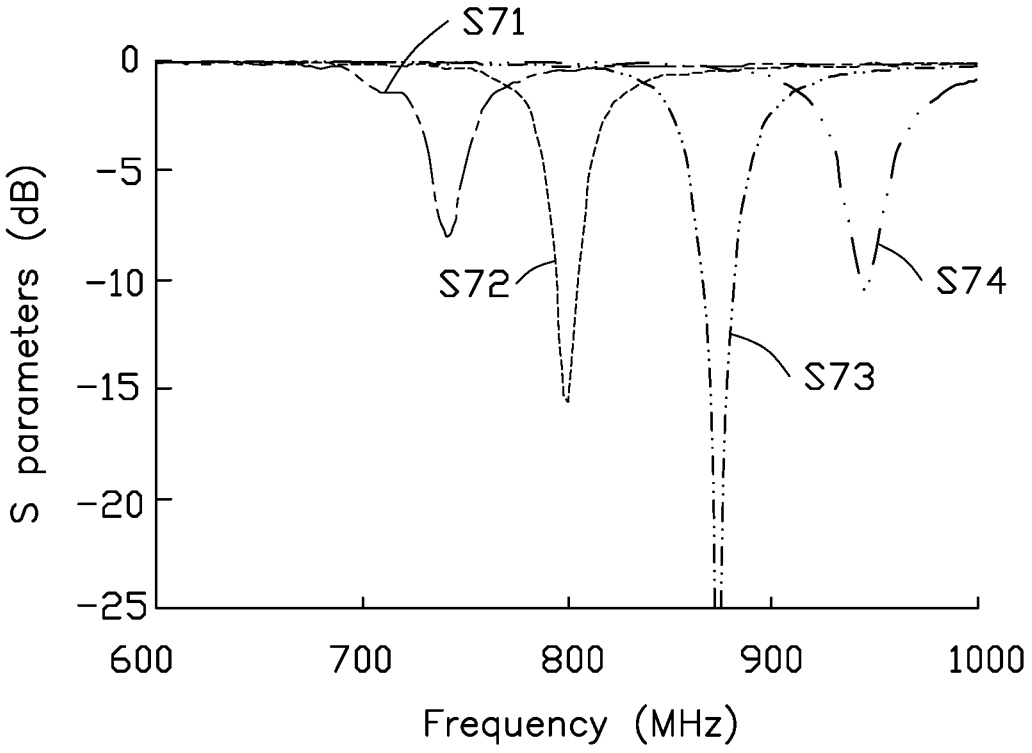
FIG. 7 is a graph of scattering values (S11 values) of the antenna structure when an electronic component is in a closed state and the switching circuit is switched to a first switching unit.

FIG. 7 shows a graph of scattering values (S11 values) of the first radiating portion A1 when the electronic component 23 is in the closed state and the switching circuit 17 is switched to the first switching unit 172. A plotline S71 represents S11 values of the first radiating portion A1 operating at 700 MHz when the electronic component 23 is in the closed state and the switching circuit 17 is switched to the first switching unit 172. A plotline S72 represents S11 values of the first radiating portion A1 operating at 800 MHz when the electronic component 23 is in the closed state and the switching circuit 17 is switched to the first switching unit 172. A plotline S73 represents S11 values of the first radiating portion A1 operating at 850 MHz when the electronic component 23 is in the closed state and the switching circuit 17 is switched to the first switching unit 172. A plotline S74 represents S11 values of the first radiating portion A1 operating at 900 MHz when the electronic component 23 is in the closed state and the switching circuit 17 is switched to the first switching unit 172.

Figure 8:
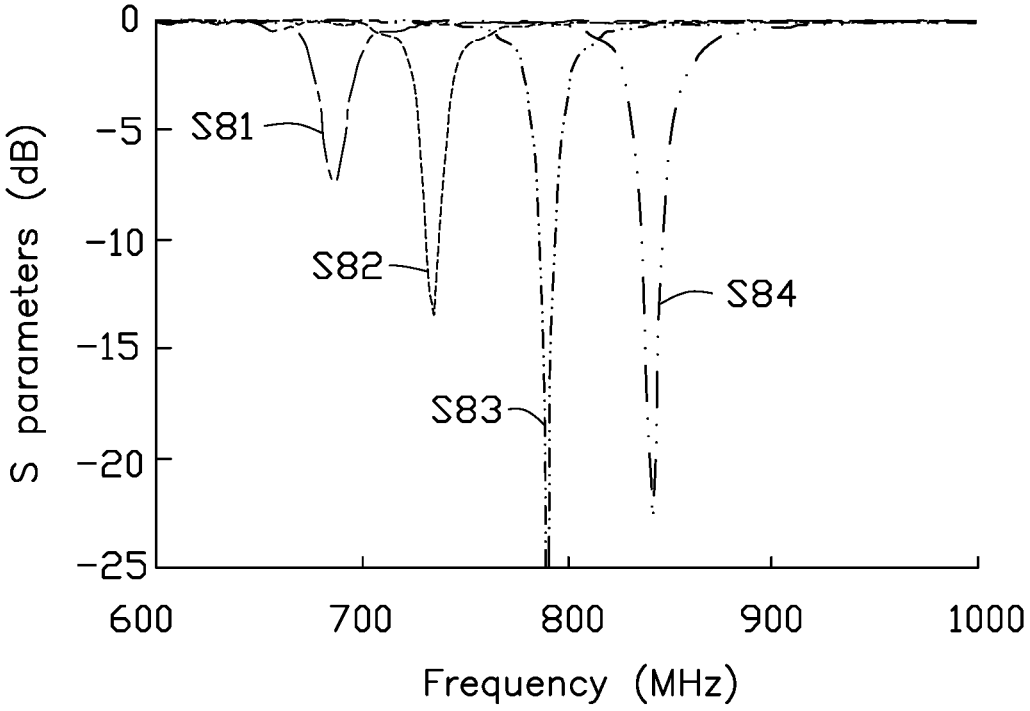
FIG. 8 is a graph of S11 values of the antenna structure when the electronic component is in an activated state and the switching circuit is switched to the first switching unit.

FIG. 8 shows a graph of S11 values of the antenna structure 100 when the electronic component 23 is in the activated state and the switching circuit 17 is switched to the first switching unit 172. A plotline S81 represents S11 values of the first radiating portion A1 operating at 700 MHz when the electronic component 23 is in the activated state and the switching circuit 17 is switched to the first switching unit 172. A plotline S82 represents S11 values of the first radiating portion A1 operating at 800 MHz when the electronic component 23 is in the activated state and the switching circuit 17 is switched to the first switching unit 172. A plotline S83 represents S11 values of the first radiating portion A1 operating at 850 MHz when the electronic component 23 is in the activated state and the switching circuit 17 is switched to the first switching unit 172. A plotline S84 represents S11 values of the first radiating portion A1 operating at 900 MHz when the electronic component 23 is in the activated state and the switching circuit 17 is switched to the first switching unit 172.

Figure 9:
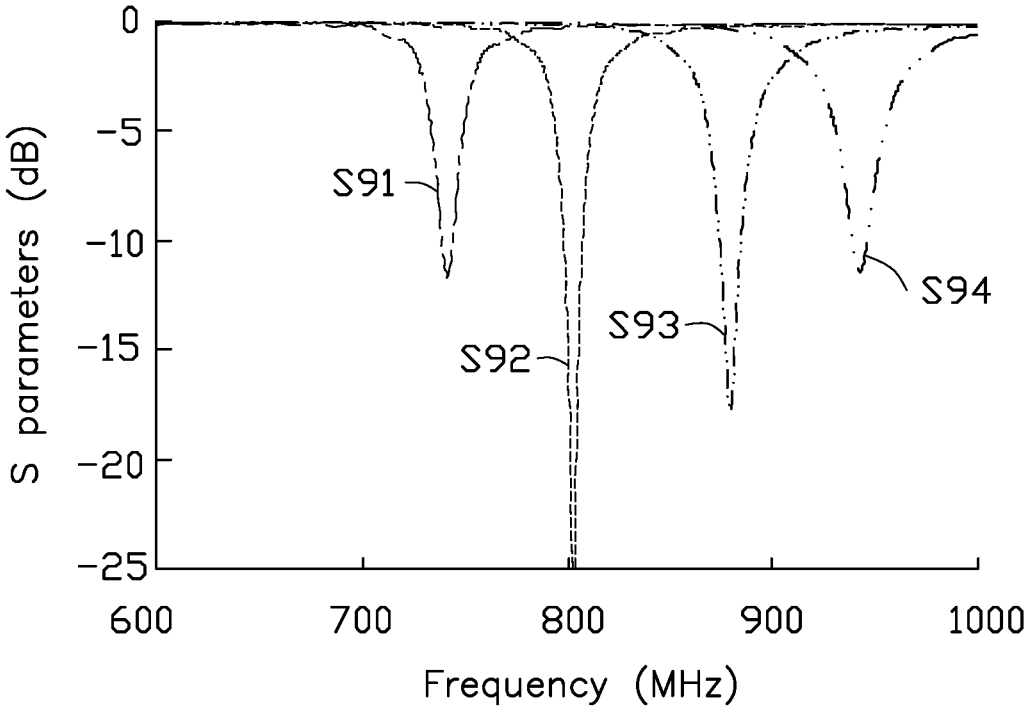
FIG. 9 is a graph of S11 values of the antenna structure when the electronic component is in the activated state and the switching circuit is switched to a second switching unit.

FIG. 9 shows a graph of S11 values of the first radiating portion A1 when the electronic component 23 is in the activated state and the switching circuit 17 is switched to the second switching unit 174. A plotline S91 represents S11 values of the first radiating portion A1 operating at 700 MHz when the electronic component 23 is in the activated state and the switching circuit 17 is switched to the second switching unit 174. A plotline S92 represents S11 values of the first radiating portion A1 operating at 800 MHz when the electronic component 23 is in the activated state and the switching circuit 17 is switched to the second switching unit 174. A plotline S93 represents S11 values of the first radiating portion A1 operating at 850 MHz when the electronic component 23 is in the activated state and the switching circuit 17 is switched to the second switching unit 174. A plotline S94 represents S11 values of the first radiating portion A1 operating at 900 MHz when the electronic component 23 is in the activated state and the switching circuit 17 is switched to the second switching unit 174.

As shown in FIGS. 7-9, when the electronic component 23 is in the activated state, the low-frequency band of the antenna structure 100 is shifted. For example, when the electronic component 23 is in the activated state and the switching circuit 17 is switched to the first switching unit 172, the low-frequency mode of the first radiating portion A1 is shifted about 80 MHz toward the low-frequency band. Thus, no matter whether the electronic component 23 is in the closed state or the activated state, the switching circuit 17 switches to one of the first switching components 173 or to one of the second switching components 175 to enhance the low-frequency function of the first radiating portion A1.

When the electronic component 23 is in the closed state, the inductance value of the frequency band is greater than the inductance value of the corresponding frequency band when the electronic component 23 is in the activated state.

Figure 10:
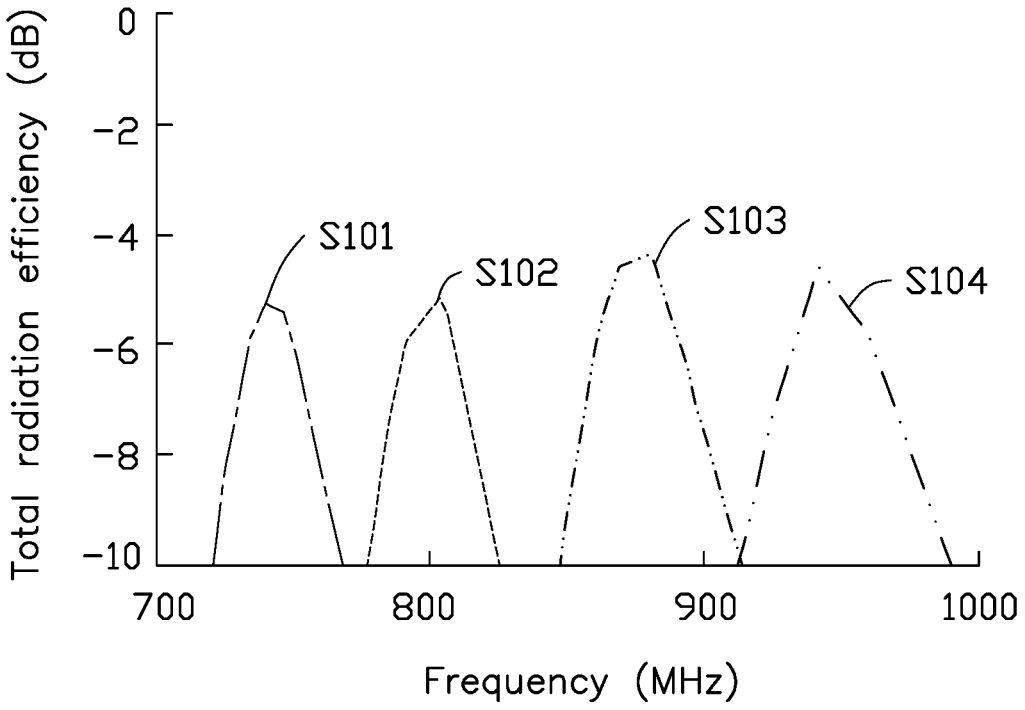
FIG. 10 is a graph of total radiation efficiency of a first radiating portion of the antenna structure when the electronic component is in the closed state.

FIG. 10 shows a graph of total radiation efficiency of the first radiating portion A1 when the electronic component 23 is in the closed state. A plotline S101 represents a total radiation efficiency of the first radiating portion A1 operating at 700 MHz when the electronic component 23 is in the closed state. A plotline S102 represents a total radiation efficiency of the first radiating portion A1 operating at 800 MHz when the electronic component 23 is in the closed state. A plotline S103 represents a total radiation efficiency of the first radiating portion A1 operating at 850 MHz when the electronic component 23 is in the closed state. A plotline S104 represents a total radiation efficiency of the first radiating portion A1 operating at 900 MHz when the electronic component 23 is in the closed state.

Figure 11:
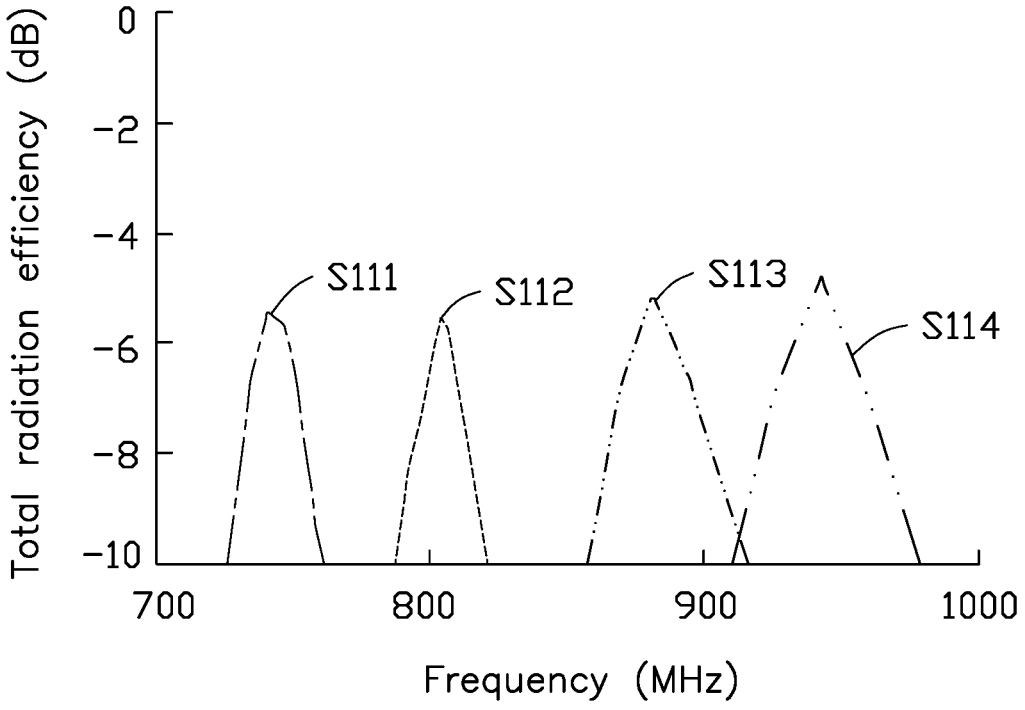
FIG. 11 is a graph of total radiation efficiency of the first radiating portion of the antenna structure when the electronic component is in the activated state.

FIG. 11 shows a graph of total radiation efficiency of the first radiating portion A1 when the electronic component 23 is in the activated state. A plotline S111 represents a total radiation efficiency of the first radiating portion A1 operating at 700 MHz when the electronic component 23 is in the closed state. A plotline S112 represents a total radiation efficiency of the first radiating portion A1 operating at 800 MHz when the electronic component 23 is in the closed state. A plotline S113 represents a total radiation efficiency of the first radiating portion A1 operating at 850 MHz when the electronic component 23 is in the closed state. A plotline S114 represents a total radiation efficiency of the first radiating portion A1 operating at 900 MHz when the electronic component 23 is in the closed state.

As shown in FIGS. 10-11, no matter whether the electronic component 23 is in the activated state or the closed state, the total radiation efficiency of the first radiating portion A1 is greater than −6 dB to satisfy requirements of a diversity antenna.

Figure 12:
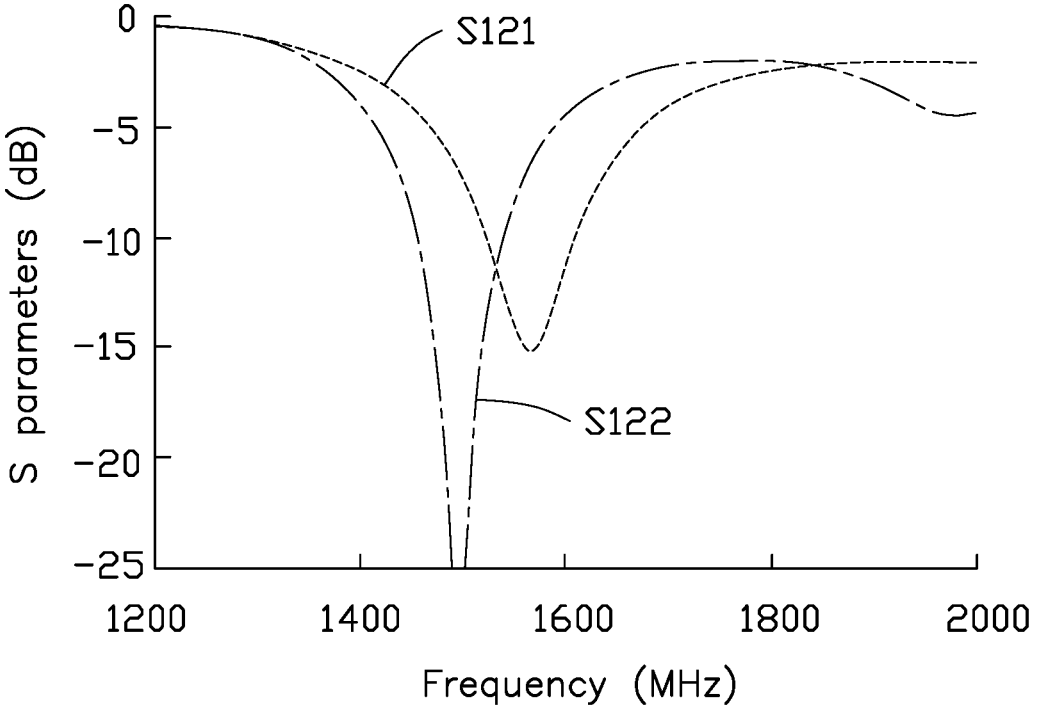
FIG. 12 is a graph of S11 values of a second radiating portion of the antenna structure.

FIG. 12 shows a graph of S11 values of the second radiating portion A2. A plotline S121 represents S11 values of the second radiating portion A2 when the electronic component 23 is in the activated state. A plotline S122 represents S11 values of the second radiating portion A2 when the electronic component 23 is in the closed state.

Figure 13:
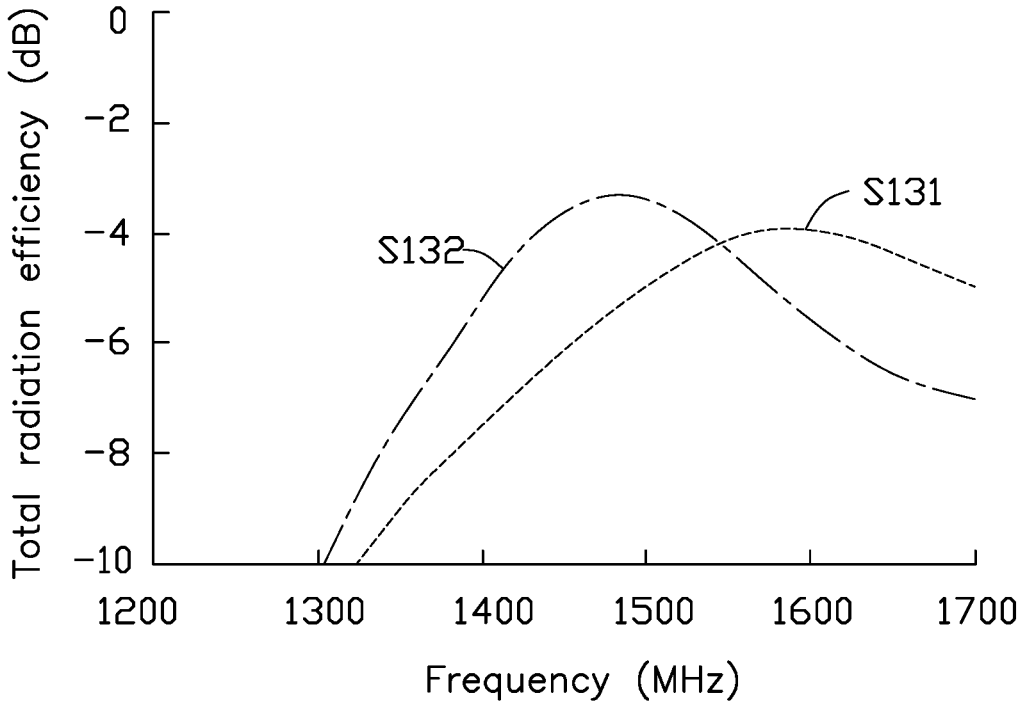
FIG. 13 is a graph of total radiation efficiency of the second radiating portion.

FIG. 13 shows a graph of total radiation efficiency of the second radiating portion A2. A plotline S131 represents a total radiation efficiency of the second radiating portion A2 when the electronic component 23 is in the activated state. A plotline S132 represents a total radiation efficiency of the second radiating portion A2 when the electronic component 23 is in the closed state.

As shown in FIGS. 12-13, no matter whether the electronic component 23 is in the activated state or the closed state, the total radiation efficiency of the second radiating portion A2 is greater than −5 dB to satisfy requirements of a GPS antenna.

Figure 14:
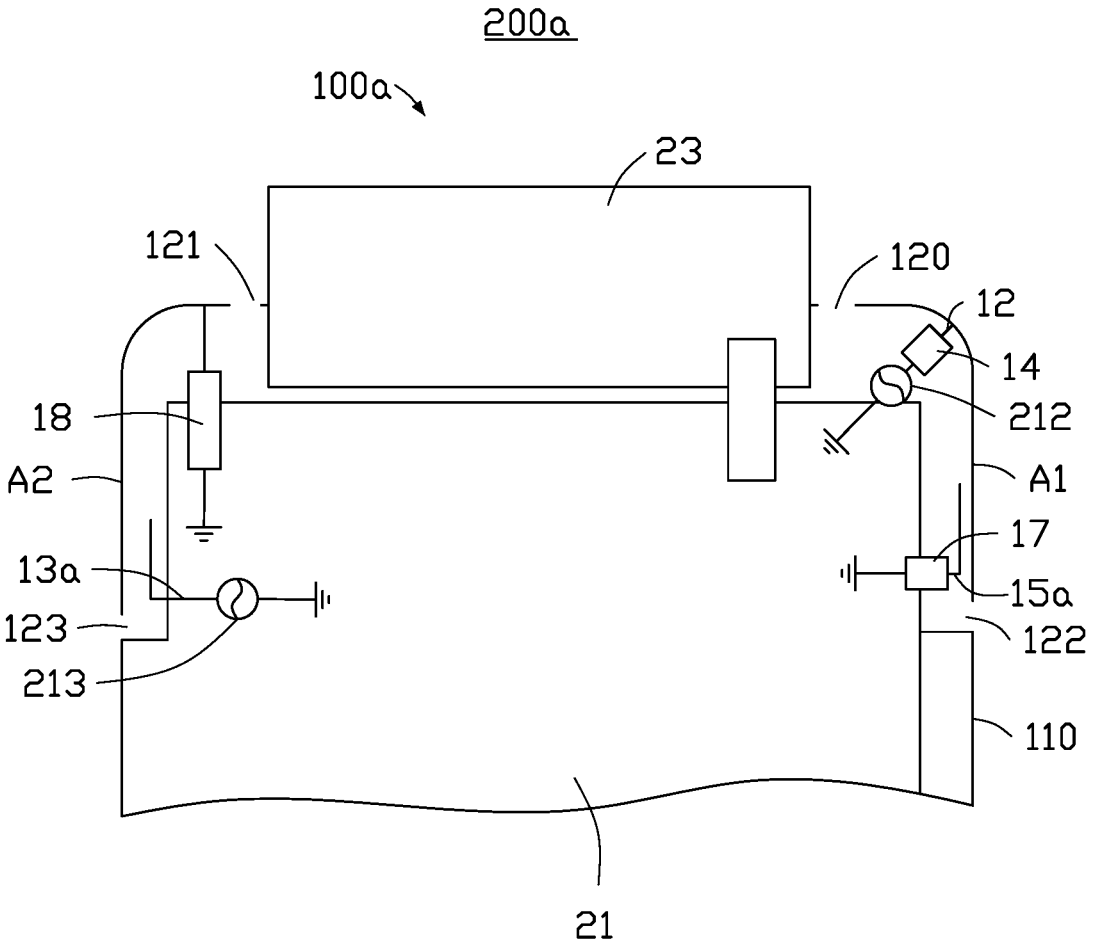
FIG. 14 is a diagram of an antenna structure in accordance with another embodiment.

FIG. 14 shows an embodiment of an antenna structure 100*a* applicable in a mobile phone, a personal digital assistant, or other wireless communication device 200*a* for sending and receiving wireless signals.

The wireless communication device 200*a* includes an electronic component 23. The antenna structure 100*a* includes a border frame 110, a first feed portion 12, a second feed portion 13*a*, a matching circuit 14, a connecting portion 15*a*, and a switching circuit 17. The border frame 110 includes a first gap 120, a second gap 121, a first slot 122, and a second slot 123. The first gap 120, the second gap 121, the first slot 122, and the second slot 123 separate the housing 11 into a first radiating portion A1 and a second radiating portion A2.

A difference between the antenna structure 100*a* and the antenna structure 100 is that the connecting portion 15*a* is not directly electrically coupled to the first radiating portion A1, but instead is spaced from the first radiating portion A1 to electrically couple to the first radiating portion A1.

Another difference between the antenna structure 100*a* and the antenna structure 100 is that the extending portion 16 is omitted.

Another difference between the antenna structure 100*a* and the antenna structure 100 is that the second feed portion 13*a* is not directly electrically coupled to the second radiating portion A2, but instead is spaced from the second radiating portion A2, such that current signals are coupled to the second radiating portion A2 across a space.

Another difference between the antenna structure 100*a* and the antenna structure 100 is that the antenna structure 100*a* further includes a ground portion 18. One end of the ground portion 18 is electrically coupled to the second radiating portion A2 or spaced from the second radiating portion A2 to electrically couple to the second radiating portion A2. A second end of the ground portion 18 is grounded to ground the second radiating portion A2.

The first radiating portion A1 and the second radiating portion A2 of the antenna structure 100 receive a current by direct contact, and so do not include a ground portion. The first radiating portion A1 and the second radiating portion A2 of the antenna structure 100*a* receive a current by current signal coupling across a space, and so the ground portion 18 is included. Thus, a resonance capability of the first antenna and the second antenna are optimized.

In other embodiments, positions of the first antenna and the second antenna can be switched.

The first antenna and the second antenna are not overlapped with the electronic component 23. In other words, the first gap 120 and the second gap 121 are located on respective opposite sides of the electronic component 23.

In other embodiments, the first antenna and the second antenna may be a WIFI antenna, a BLUETOOTH antenna, a near-field communication antenna, or other suitable antenna.

The antenna structure 100/100*a* of the wireless communication device 200/200*a* is disposed on opposite sides of the electronic component 23 by the first radiating portion A1 and the second radiating portion A2. By appropriately adjusting the feeding, grounding, and switching circuits of the first radiating portion A1 and the second radiating portion A2, characteristics such as wide frequency and good antenna efficiency can be effectively achieved. Furthermore, the antenna structure 100/100*a* can be applied in an environment where the antenna space is limited, and the electronic component 23 can effectively avoid overlapping with the antenna structure 100/100*a* while ensuring a screen integrity of the display unit 201. Thus, a shielding effect of the antenna structure 100/100*a* is more beautiful and practical.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure comprising:

a border frame made of metal and comprising an end portion, a first side portion, and a second side portion;

a first feed portion;

a second feed portion; wherein:

the first side portion and the second side portion are respectively coupled to opposite ends of the end portion and face each other;

the border frame defines a first gap, a second gap, a first slot, and a second slot;

the first gap and the second gap is disposed in the end portion;

the first slot is disposed in the first side portion;

the second slot is disposed in the second side portion;

the first gap, the second gap, the first slot, and the second slot pass through the border frame and divide the border frame into two radiating portions;

the two radiating portions are located at different sides of the border frame and at two opposite sides of an electronic component, the border frame receives the electronic component therein and is slidable relative to the electronic component;

the first feed portion and the second feed portion are electrically coupled to the two radiating portions and configured to supply current to the two radiating portions respectively.

2. The antenna structure of claim 1, wherein:

the two radiating portions are defined as a first radiating portion and a second radiating portion;

the first radiating portion is disposed in a portion of the border frame between the first gap and the first slot;

the second radiating portion is disposed in a portion of the border frame between the second gap and the second slot.

3. The antenna structure of claim 2 further comprising a connecting portion, wherein:

one end of the first feed portion is electrically coupled to the first radiating portion directly or indirectly;

a second end of the first feed portion is electrically coupled to a first feed source through a matching circuit to supply current to the first radiating portion;

one end of the second feed portion is electrically coupled to the second radiating portion directly or indirectly;

a second end of the second feed portion is electrically coupled to a second feed source to supply current to the second radiating portion;

one end of the connecting portion is electrically coupled to the first radiating portion directly or indirectly;

a second end of the connecting portion is grounded.

4. The antenna structure of claim 3 further comprising a switching circuit, wherein:

the switching circuit comprises a switch, a first switching unit, and a second switching unit;

the switch is electrically coupled to the connecting portion;

the first switching unit comprises a plurality of first switching components coupled in parallel;

one end of each of the plurality of first switching components is electrically coupled to the switch, and a second end of each of the plurality of first switching components is grounded;

the second switching unit comprises a plurality of second switching components coupled in parallel;

one end of each of the plurality of second switching components is electrically coupled to the switch, and a second end of the plurality of second switching components is grounded;

the switch is configured to switch the first radiating portion to electrically coupled to the first switching components or the second switching components to adjust a resonance frequency of the first radiating portion.

5. The antenna structure of claim 1 further comprising an extending portion, wherein:

the extending portion comprises a first extending section, a second extending section, and a third extending section connected in sequence;

one end of the first extending section is perpendicularly connected to a side of the second feed portion away from the first side portion and extends parallel to the end portion in a direction toward the second side portion;

one end of the second extending section is perpendicularly connected to an end of the first extending section away from the second feed portion and extends parallel to the first side portion and extends in a direction opposite to the end portion;

one end of the third extending section is connected perpendicularly to an end of the second connecting section away from the first extending section and extends parallel to the first extending section and extends in a direction toward the first side portion;

a second end of the third extending section is grounded.

6. The antenna structure of claim 1, wherein the two radiating portions are at least two of a global positioning system (GPS) antenna, a WIFI antenna, a Diversity antenna, a BLUETOOTH antenna, and a near field communication (NFC) antenna.

7. A wireless communication device comprising an electronic component and an antenna structure, the antenna structure comprising:

a border frame made of metal and comprising an end portion, a first side portion, and a second side portion;

a first feed portion;

a second feed portion; wherein:

the first side portion and the second side portion are respectively coupled to opposite ends of the end portion and face each other;

the border frame defines a first gap, a second gap, a first slot, and a second slot;

the first gap and the second gap is disposed in the end portion;

the first slot is disposed in the first side portion;

the second slot is disposed in the second side portion;

the first gap, the second gap, the first slot, and the second slot pass through the border frame and divide the border frame into two radiating portions;

the two radiating portions are located at different sides of the border frame;

the first feed portion and the second feed portion are electrically coupled to the two radiating portions and configured to supply current to the two radiating portions respectively;

wherein the electronic component is received in the border frame and is slidable relative to the border frame, the two radiating portions are located at two opposite sides of the electronic component.

8. The wireless communication device of claim 7, wherein:

the two radiating portions are defined as a first radiating portion and a second radiating portion;

the first radiating portion is disposed in a portion of the border frame between the first gap and the first slot;

the second radiating portion is disposed in a portion of the border frame between the second gap and the second slot.

9. The wireless communication device of claim 8, wherein:

the antenna structure further comprises a connecting portion;

one end of the first feed portion is electrically coupled to the first radiating portion directly or indirectly;

a second end of the first feed portion is electrically coupled to a first feed source through a matching circuit to supply current to the first radiating portion;

one end of the second feed portion is electrically coupled to the second radiating portion directly or indirectly;

a second end of the second feed portion is electrically coupled to a second feed source to supply current to the second radiating portion;

one end of the connecting portion is electrically coupled to the first radiating portion directly or indirectly;

a second end of the connecting portion is grounded.

10. The wireless communication device of claim 9, wherein:

the wireless communication device further comprises an extending portion;

the extending portion comprises a first extending section, a second extending section, and a third extending section connected in sequence;

one end of the first extending section is perpendicularly connected to a side of the second feed portion away from the first side portion and extends parallel to the end portion in a direction toward the second side portion;

one end of the second extending section is perpendicularly connected to an end of the first extending section away from the second feed portion and extends parallel to the first side portion and extends in a direction opposite to the end portion;

one end of the third extending section is connected perpendicularly to an end of the second connecting section away from the first extending section and extends parallel to the first extending section and extends in a direction toward the first side portion;

a second end of the third extending section is grounded.

11. The wireless communication device of claim 10, wherein the two radiating portions are at least two of a global positioning system (GPS) antenna, a WIFI antenna, a Diversity antenna, a BLUETOOTH antenna, and a near field communication (NFC) antenna.

12. The wireless communication device of claim 11 further comprising a display unit and a backplane, wherein:

the display unit is received within the border frame;

the backplane is made of metal;

the backplane is mounted on a side of the border frame opposite to the display unit and is integrally formed with the border frame.

13. The wireless communication device of claim 12, wherein the electronic component is an optical module or an acoustic module.

14. The wireless communication device of claim 12, wherein:

the antenna structure further comprises a switching circuit;

the switching circuit comprises a switch, a first switching unit, and a second switching unit;

the switch is electrically coupled to the connecting portion;

the first switching unit comprises a plurality of first switching components coupled in parallel;

one end of each of the plurality of first switching components is electrically coupled to the switch, and a second end of each of the plurality of first switching components is grounded;

the second switching unit comprises a plurality of second switching components coupled in parallel;

one end of each of the plurality of second switching components is electrically coupled to the switch, and a second end of each of the plurality of second switching components is grounded;

when the electronic component is mounted within the border frame, the switch is configured to switch the first radiating portion to electrically coupled to the first switching components or the second switching components to adjust a resonance frequency of the first radiating portion;

when the electronic component is slid out of the border frame, the switch is controlled to switch the first radiating portion to electrically coupled selectively to the plurality of first switching components or selectively to the plurality of second switching components to adjust a resonance frequency of the first radiating portion.

* * * * *